United States Patent [19]

Parker

[11] Patent Number: 4,700,448

[45] Date of Patent: Oct. 20, 1987

[54] PROCESS FOR THE MANUFACTURE OF A STICK PUSH-UP DEVICE

[75] Inventor: Thomas J. Parker, Fayetteville, N.Y.

[73] Assignee: American Cyanamid Company, Stamford, Conn.

[21] Appl. No.: 349,880

[22] Filed: Feb. 18, 1982

Related U.S. Application Data

[63] Continuation of Ser. No. 180,282, Aug. 22, 1980, abandoned, which is a continuation of Ser. No. 960,523, Nov. 14, 1978, abandoned.

[51] Int. Cl.[4] ..... B23P 11/00

[52] U.S. Cl. ..... 29/434; 29/235; 29/451; 29/458; 53/122; 264/274; 401/98; 401/217

[58] Field of Search ..... 29/235, 451, 434, 458; 53/428, 122, 329, 331, 471, 490; 401/82, 98, 49, 217, 276; 264/259, 267, 268, 274; 425/DIG. 32

[56] References Cited

U.S. PATENT DOCUMENTS

| | | | |
|---|---|---|---|
| 2,505,211 | 4/1950 | Schiesel | 401/217 |
| 2,647,556 | 8/1953 | Courtney | 29/235 UX |
| 2,743,991 | 7/1956 | Sherman | 401/98 |
| 2,879,548 | 3/1959 | Croce et al. | 264/268 |
| 3,397,027 | 8/1968 | Harrison | 401/82 X |
| 3,443,874 | 5/1969 | Pelli et al. | 401/82 |
| 3,453,056 | 7/1969 | Motsavage et al. | 401/49 X |
| 4,023,912 | 5/1977 | Mahler et al. | 401/82 |
| 4,069,574 | 1/1978 | Krevald et al. | 29/434 |
| 4,139,311 | 2/1979 | Lorscheidt | 401/98 X |

FOREIGN PATENT DOCUMENTS

| | | | |
|---|---|---|---|
| 592390 | 9/1947 | United Kingdom | 401/82 |

*Primary Examiner*—Charlie T. Moon
*Attorney, Agent, or Firm*—C. J. Fickey

[57] ABSTRACT

A process for manufacturing a wax-like cosmetic stick having an improved contour on its upper surface, by filling at the open bottom of the case with the stick material in a molten state, the case having a cap which provides the contour, allowing the stick to partially solidify, while maintaining the upper surface molten, placing a push-up device in the bottom of the case, seating the push-up device against the molten upper surface, said push-up being designed to allow substantially all of the air to escape during seating, then allowing final solidification of the stick.

4 Claims, 16 Drawing Figures

PROCESS FOR THE MANUFACTURE OF A STICK PUSH-UP DEVICE

This is a continuation of application Ser. No. 180,282, filed Aug. 22, 1980, now abandoned, which is a continuation of application Ser. No. 960,523, filed Nov. 14, 1978, now abandoned.

This invention relates to a method for the manufacture of a solid, low melting, wax-like cosmetic or pharmaceutical stick. More particularly, it relates to a novel method for the manufacture of a cosmetic stick, especially an antiperspirant stick, having a custom molded top surface.

Most cosmetic sticks, including deodorant and antiperspirant compositions, comprise a solid, waxy, low melting formulation, containing an active ingredient, where applicable, encased in a suitable container provided with a means for pushing the stick upwards through the container to expose more surface as the stick is consumed. Heretofore, the conventional method of fabricating these sticks, particularly doedorant and antiperspirant sticks, has been by pouring the molten composition into the top of a suitable container equipped with a suitable push-up device in the bottom thereof. In so doing, a pouring cap, open at the top, or pouring device, is first attached to the top of the container in a removable manner. Ordinarily, excess of the formulation remains in the pouring cap, so that when the composition hardens, and the pouring cap is removed from the container, the excess is cut away from the stick by means of a knife. The knife usually consists of a wire fixed into the pouring cup. When the pouring cap is removed, usually with a twisting action, the wire cuts off the excess, leaving the stick with a flat surface.

The method described results in a product having a number of disadvantages. In cutting of the excess at the top of the stick, a top surface is formed on the stick which is substantially perpendicular to the longitudinal axis of the stick, thereby forming a squared edge. When this edge is applied to a surface, it results in crumbling, with resultant loss of material until a rounded edge finally forms. Moreover, the cutting of the top edge results in a certain amount of waste product. In addition, during cooling and solidification of the stick material as poured in the container, the top surface contracts leaving air voids creating an unfavorable effect esthetically in the mind of the user.

In U.S. Pat. No. 4,914,371, an improved process for producing an antiperspirant stick was disclosed in which the container housing, with a cap attached and having a mold within the cap for providing a contour to the top of the stick, was filled from the bottom with molten antiperspirant composition. After solidification, a push-up device was inserted through the bottom of the housing, the push-up device having at least one perforation through its base plate, and the solid stick was seated against the push-up by means of a vacuum applied to the bottom of the push-up device.

Although this process resulted in a stick having a contoured top which was more esthetically pleasing, the stick was not firmly bonded to the push-up with the result that the stick often became detached from the push-up and fell out of the container.

In my copending application Ser. No. 960,524 filed Nov. 14, 1978, a process is disclosed to provide a cosmetic stick, particularly an antiperspirant stick, with an esthetically pleasing, custom molded upper surface, and which is firmly bonded to the push-up in the base of the container.

In the process of my copending application, the molten material is poured into the bottom of a suitable container having a top attached which will form a contour to the surface of the stick. The molten material is then allowed to solidify while maintaining the surface adjacent the bottom of the container in the molten state. A push-up device having at least one perforation in the base plate is then inserted into the bottom of the case. The push-up is then seated into the molten surface and the stick is then allowed to solidify. The stick and push-up are then moved into the case to bring the push-up to the bottom of the container. While this process also results in a cosmetic stick having an esthetically pleasing contour on its top surface and the stick is more firmly bonded to the push-up, the process was found to have certain disadvantages. In seating the push-up into the molten material, it has been found that the air within the container is not evacuated completely and some of it is forced into the stick, creating voids which are undesirable since they spoil the homogeneity of the solid stick. In addition some of the molten material is forced through the holes in the base plate and solidifies on the outer surface of the push-up. This is undesirable since it contacts the hands of the user. Thus the extruded material had to be removed by hand if its undesirable effect is to be removed. Moreover, if a printed code is placed on the push-up before insertion, the extruded material smeared the ink, destroying the code, and necessitating putting on the code again.

It is therefore an object of the invention to provide a process and means to obtain a cosmetic stick which is free from air voids.

Another object is to provide a cosmetic stick which is firmly bonded to a push-up device and free from stick material on the outer surface of the push-up.

A further object is to provide a novel push-up device for a cosmetic stick package which permits substantially all of the air to escape during seating of the push-up and prevents extrusion of stick material to the outer surface of the push-up.

These and other objects of the invention will become apparent as the description thereof proceeds.

The disadvantages of the prior process may be overcome and the above objects attained by the use of my present invention. Briefly, the invention consists of the use of a novel push-up device having means to allow rapid escape of substantially all of the air in the container and which traps extruded molten material before it may reach the outer surface of the push-up. The push-up device comprises a flat base plate with an upper and lower rim and having an annular concave area around the perimeter of the base plate and between said upper and lower rims to form an annular cavity between the push-up and the inner wall of the container when the push-up is positioned in the container. At least one perforation is present in the upper rim and one in the lower rim. The upper rim perforation forms a conduit between the upper or inner surface of the push-up and the annular cavity, and the lower rims perforation forms a conduit between the annular cavity and the lower or outer surface of the push-up. When the push-up is seated into the molten surface of the stick, air escapes through the upper conduit into the annular cavity and then through the lower conduit out of the container. Moreover, any extruded molten material remains in the annular cavity which is not visible from the exterior of the stick.

The invention will be better understood by reference to the drawings in which.

Figure 13:
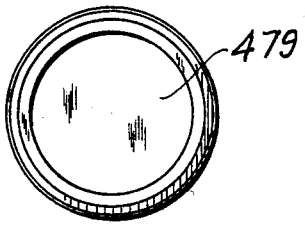
FIGS. 13 and 14 are respectively top and bottom views of the insert of FIG. 12.
Figure 12:
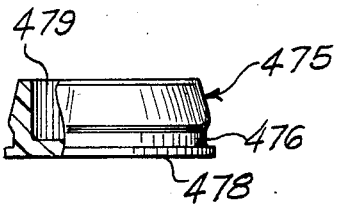
FIG. 12 is an elevational view with parts broken away of an insert for fitting into the bottom of the push-up of FIGS. 9, 10 and 11.

Referring to FIG. 13, a reactor 22 is charged via line 20 with the ingredients to prepare the cosmetic stick formulation, which is then held until needed in a heated holding kettle 24.

Figure 1:
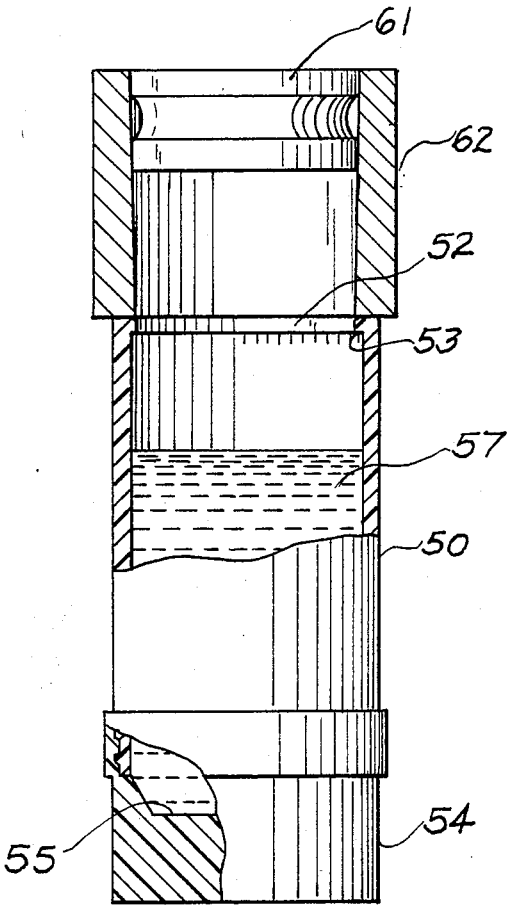
FIG. 1 is a view in elevation of an inverted container with mold cap, and reducing collar at the bottom, filled with molten material and push-up prior to insertion, with parts broken away to show a cross-section of the container, cap and collar.
Figure 2:
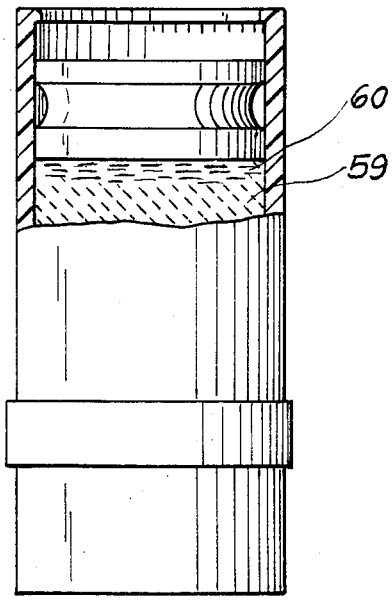
FIG. 2 is a view similar to FIG. 1 after insertion of the push-up.
Figure 3:
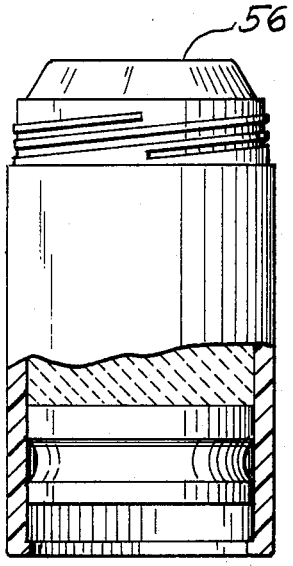
FIG. 3 is a view of the container right side up, in which the push-up is seated and mold collar detached, with parts in cross-section.
Figure 4:
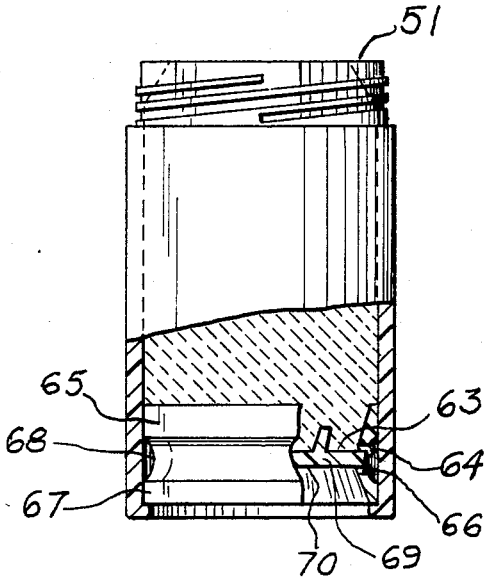
FIG. 4 is a view similar to FIG. 3 with push-up and cosmetic stick positioned in the container, with partial cross-section of the push-up.

In a continuous manner a housing orientator 12 aligns the container bodies or housings 50 (see FIG. 1) which are open at the top 51 and bottom 52, with a flange 53 adjacent the bottom opening (see FIG. 4), in an upright position on a conveyor belt 10. Container 50 then moves to a capping device 14 which affixes onto top 51 of container 50 a pouring cap 54, which closes top end 51 of container 50. The interior surface 55 of cap 54 is shaped to form the custom upper surface 56 of the stick (see FIG. 3). This may be done by using a cap having a molded interior as shown in FIG. 1, or by inserting any desired mold into a cap. When the pouring cap has been affixed, a flipover device 16 inverts container 50, as shown in FIG. 1, so that it may be filled from the open bottom 52 via a filling device 18, via a line 26, whereby a premeasured quantity of formulation 57 in the molten state is added to container 50. The filled container is then passed through refrigerated tunnel 28 where molten material 57 is allowed to cool and solidify to form the stick product as shown at 59 (FIG. 2) while maintaining the upper surface 60 heated to maintain this portion of the stick in the molten state. A reducing collar 62 is then affixed to container 50 contiguous to bottom opening 52. A single piece push-up device 61 is inserted in the collar 62 and inserted into container 50 by means of downward pressure of inserter 30, to a position just above molten surface 60. The push-up 61 is then pushed into molten surface 60 by push-up seater 32 until a certain predetermined pressure is attained. This pressure is determined experimentally and should be sufficient to make complete contact of the upper surface 63 of push-up base plate 69. Push-up 61 is provided with hole 64 through upper rims 65 and hole 66 through lower rim 67, leading into a concave annular groove 68 between upper rim 65 and lower rim 67. When push-up 61 is forced into molten surface 60, air present between the upper surface 63 and molten surface 60 escapes through hole 64 into cavity 68 and out through holes 66. This allows complete contact of the molten surface 60 with push-up upper surface without causing air voids in the stick material. If any molten material is forced through hole 64, it is trapped in cavity 68 and is not present on lower surface 70 of push-up base plate 69.

The molten surface 60 is then cooled in final solidification step 34.

The container 50 is inverted by a flipover device 36 and then travels to an uncapping device 38 which removes the pouring cap 54 from the top of the container 50. When pouring cap 54 is removed, the upper molded surface 56 of the stick 59 is above the container top 51. (see FIG. 3) If it is desired to have the stick entirely within the container, stick 51 and push-up 61 may be moved downward into housing 50 until push-up 61 is at the bottom edge of the container housing 50. This may be accomplished by passing the uncapped container 50 to a vacuum table 42, where a vacuum applied at the bottom 52 which pulls the stick and push-up down into the container until push-up 61 is seated against flange 53 of the stick 59 or below the upper edge 51 of container 50 (see FIG. 4). Finally, the container is capped by the capper device 44 with a cap which may be similar to the pouring cap 54 without any internal mold surface. Push-up 61 is advantageously molded in one piece from a suitable resiliant plastic.

Figure 6:
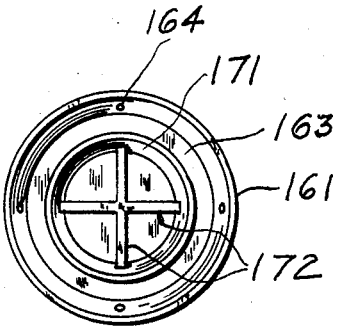
FIGS. 6 and 7 are respectively top and bottom plan views of the push-up of FIG. 5.
Figure 7:
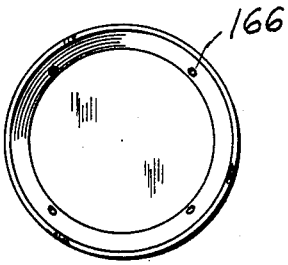
Figure 5:
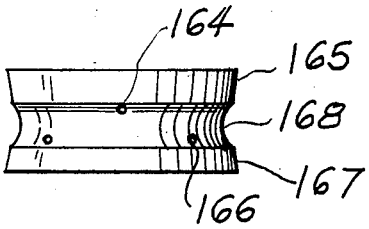
FIG. 5 is an elevational view of a push-up with holes in the rims above and below the plate.

The push-up device 61 has been illustrated with one upper hole 64 adjacent one lower hole 66. It is also advantageous to use a plurality or upper and lower holes in push-up 61 as shown in FIGS. 5, 6 and 7. It would be possible to use two upper and two lower holes which are vertically alligned, or the lower holes may be displaced by 90 degrees around the push-up circumference from the upper holes. As illustrated in FIGS. 5, 6 and 7 push-up 161 has four upper holes 164 and four lower holes 166 which are displaced 45 degrees circumferentially from the upper holes 164. The upper and lower rims 165 and 167 may have an outward flair. To further aid in forming a more firm bond between the stick and the push-up, vertical projections may be provided on the upper surface 163. As shown in FIG. 6, there projections may be a circular rib 171 and crossed ribs 172. When the push-up 161 is seated in the molten surface 60 the ribs 167 and 168 will be imbedded in the stick after it becomes solidified. In addition, when molten material is extruded through upper rim holes 164 and into annular cavity 169, after solidification this also aids in securing the stick firmly to the push-up.

Figure 8:
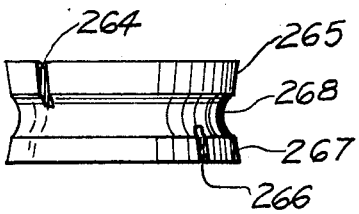
FIG. 8 is an elevational view of a push-up having slots in the rims above and below the base plate.

FIG. 8 illustrates a variation in the push-up device. The overall configuration is generally the same as that of FIG. 5, except that the holes 164 and 166 are replaced by slots 264 and 266 which are vertically alligned.

Figure 10:
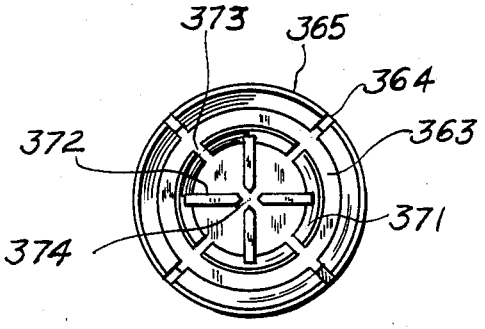
FIGS. 10 and 11 are respectively top and bottom plan views of the push-up of FIG. 9.
Figure 9:
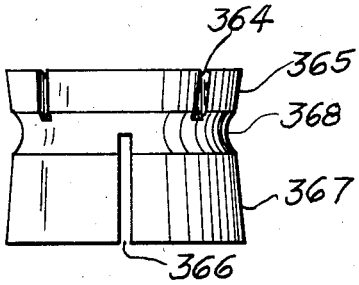
FIG. 9 is an elevational view of a push-up with slots, similar to that of FIG. 8 with an extended lower rim.
Figure 11:
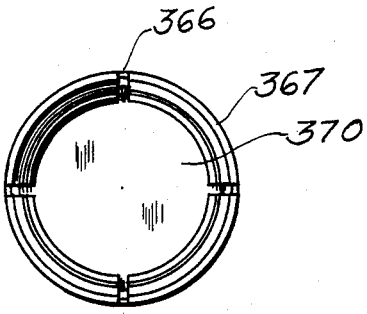

FIGS. 9, 10 and 11 show a modified push-up device having slots 364 in upper rim 365 and slots 366 in an extended lower rim 367. The vertical ribs on the upper surface 363 of the push-up have also been modified. Circular rib 371 has slots 373 and crossed ribs 372 are interrupted at 374. Thus free air flow is provided over all sections of the push-up surface 363 and the escape of air is greatly facilitated over all parts of surface 363, so that no entrapment of air within the stick is likely. Slots 373 may also be V-shaped notches or any other suitable configuration.

Figure 14:
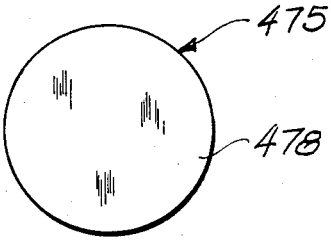
Figure 15:
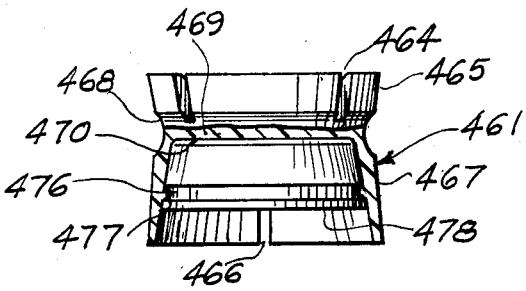
FIG. 15 is an elevational view of the push-up of FIG. 9 with parts broken away to show fitting of the insert.
Figure 16:
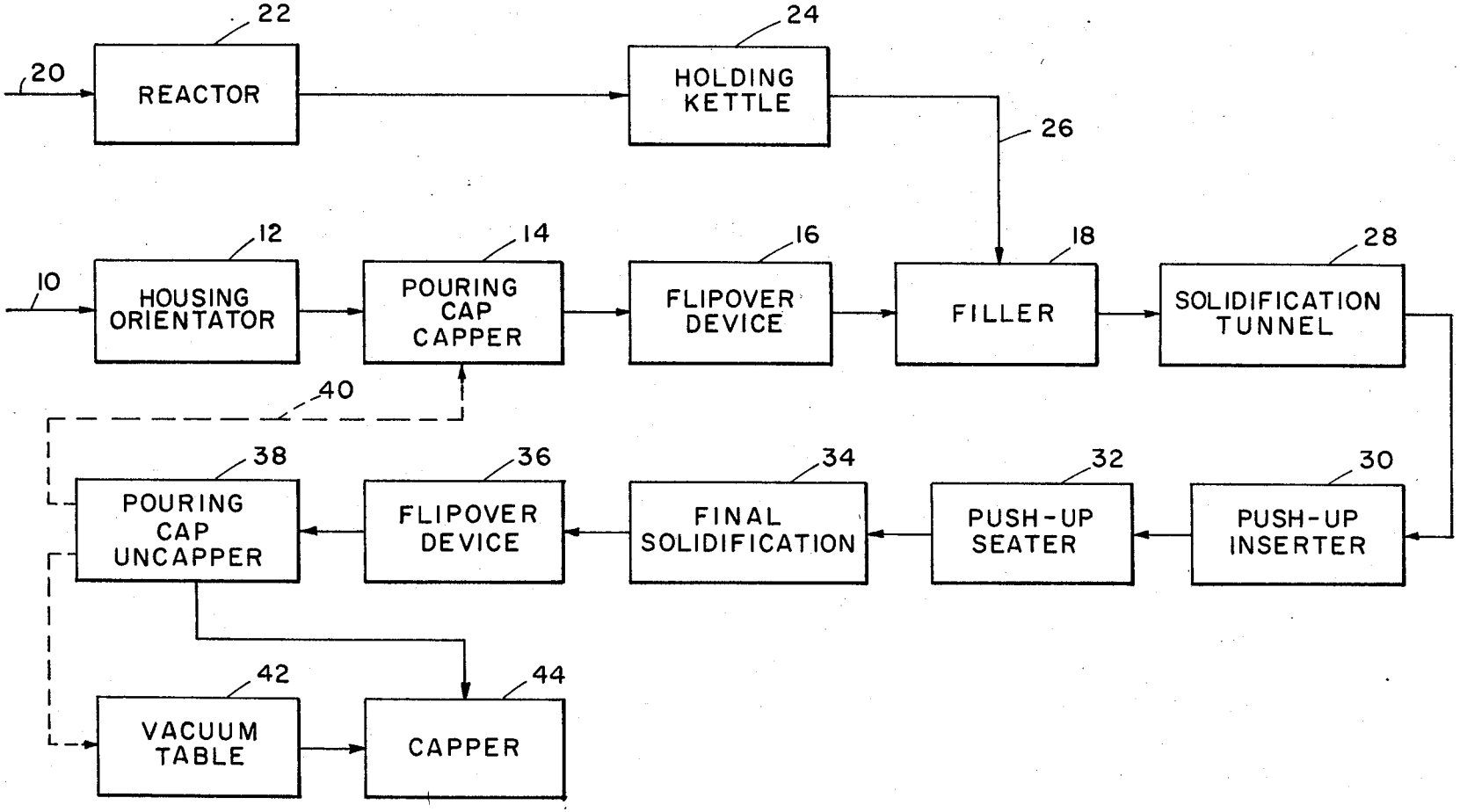
FIG. 16 is a flow diagram showing the process steps for forming the cosmetic stick.

FIGS. 13 to 15 represent a further embodiment of the push-up in FIGS. 9 to 11. In this embodiment, an additional insert plate 475 is provided which fits into the extended lower rim of push-up 461. The insert 475 is locked into push-up 461 by means of an annular groove 476 in the insert and an annular projection 477 in the inner surface of lower rim 467. Insert 475 has a flat lower surface 478 and recess 479 on the upper side. By use of insert 475, the exposure of extruded stick material is further precluded. If the seating pressure would be high enough to extrude molten material from surface 60 through slots 464 into cavity 468 and through slots 466 so that some material is deposited on lower surface 470 of base plate 469, this will be concealed by insert 475, and there is no possibility of this extruded material contacting the fingers of the user.

As a further modification of the push-up in FIGS. 12 to 15, the insert 475 may be made a permanent part of the push-up by molding a base across the bottom of rim 467, and leaving the area above the base hollow.

The number of openings, e.g. holes or slots in the push-up rims is not critical although it has been shown as one, two or four. The size of the openings will depend on the molten material viscosity, the seating pressure and the number of openings.

In addition the ribs on the upper surface of the push-up may take any convenient configuration although a circular rib with straight crossed ribs has been shown.

The method and means of the invention is particularly useful for the preparation of deodorant and antiperspirant sticks, but may be used effectively for other cosmetic, pharmaceutical or other formulations in stick form.

I claim:

1. A process for the manufacture of a solid, wax-like cosmetic or pharmaceutical stick product, which comprises the steps of attaching a pouring cap closure to the upper portion of a suitable container for raid stick, said container being open at the bottom; inverting said container body and filling from the bottom thereof with a premeasured quantity of said cosmetic or pharmaceutical composition in a molten state; cooling said composition to form within said container a solid, wax-like stick, while maintaining the upper surface molten, inserting into the bottom portion of said container body, a push-up device, said push-up device having means for escape of air within said container, without passing through the base thereof and without extrusion of molten composition through the base thereof , seating said push-up device against said molten surface, solidifying said molten surface, re-inverting the container and removing said pouring cap; and affixing a cap to said container.

2. The process according to claim 1 wherein said container is a cylindrical body threaded on the upper portion to receive a cap and having a flange incorporated in the bottom as a seat for said push-up device.

3. A process for the manufacture of a solid, wax-like cosmetic or pharmaceutical stick, having a custom molded upper surface, which comprises the steps of attaching a pouring cap closure to the upper portion of a suitable container for said stick, said container being open at the bottom, said pouring cap having therein a mold, said mold forming the shape and design of the upper surface of the stick; inverting said container body and filling from the bottom thereof with a premeasured quantity of the molten cosmetic or pharmaceutical composition; cooling said composition to form within said container a solid, wax-like stick having a custom molded upper surface within said cap, while maintaining the bottom surface of said stick molten; inserting into the bottom portion of said container body a push-up device having means for escape of air within said container, without passing through the base thereof and without extrusion of molten composition through the base thereof, by means of a reducing collar attached removably to the bottom of said body; seating said push-up against said molten surface under predetermined pressure; solidifying said molten surface; re-inverting the container and removing said pouring cap; and affixing a cap to said container.

4. A process for the manufacture of a solid, wax-like cosmetic of pharmaceutical stick, having a custom molded upper surface, which comprises the steps of (1) attaching a pouring cap closure to the upper portion of a suitable container having a cylindrical body threaded on the upper portion thereof to threadedly receive a cap thereon and for said stick, said container being open at the bottom and having a flange incorporated therein as a seat for said push-up device, said pouring cap having an interior configuration adapted to mold and form the shape and design of the upper surface of the stick; (2) inverting said container body and filling from the bottom thereof with a premeasured quantity of the molten cosmetic or pharmaceutical composition; (3) cooling said composition to form within said container a solid, wax-like stick having a custom molded upper surface while maintaining the bottom surface of the stick molten; (4) inserting into the bottom portion of said container a single piece plastic push-up device, by means of a reducing collar attached removably to said body, said push-up device having means for escape of air from said container, without passing through the base thereof and without extrusion of molten composition through the base thereof; (5) seating said push-up device in said molten surface of said stick under predetermined pressure; allowing said molten surface to solidify; (6) re-inverting said container and removing said pouring cap; and (7) affixing a cap to said container.

* * * * *